US006106371A

United States Patent [19]

Nagahara et al.

[11] Patent Number: 6,106,371

[45] **Date of Patent: *Aug. 22, 2000**

[54] EFFECTIVE PAD CONDITIONING

[75] Inventors: Ronald J. Nagahara, San Jose; Dawn M. Lee, Morgan Hill, both of Calif.

[73] Assignee: LSI Logic Corporation, Milpitas, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/961,383

[22] Filed: Oct. 30, 1997

[51] Int. Cl.[7] ..... B24B 1/00

[52] U.S. Cl. ..... 451/56; 451/72; 451/526

[58] Field of Search ..... 451/56, 72, 526

[56] References Cited

U.S. PATENT DOCUMENTS

| | | | |
|---|---|---|---|
| 5,081,051 | 1/1992 | Mattingly et al. . | |
| 5,216,843 | 6/1993 | Breivogel et al. . | |
| 5,245,790 | 9/1993 | Jerbic . | |
| 5,265,378 | 11/1993 | Rostoker . | |
| 5,310,455 | 5/1994 | Pasch et al. . | |
| 5,321,304 | 6/1994 | Rostoker . | |
| 5,389,194 | 2/1995 | Rostoker et al. . | |
| 5,403,228 | 4/1995 | Pasch . | |
| 5,456,627 | 10/1995 | Jackson et al. | 451/11 |
| 5,456,630 | 10/1995 | Kaiser et al. . | |
| 5,516,400 | 5/1996 | Pasch et al. . | |
| 5,527,424 | 6/1996 | Mullins | 156/636.1 |
| 5,536,202 | 7/1996 | Appel et al. . | |
| 5,547,417 | 8/1996 | Breivogel et al. . | |
| 5,605,499 | 2/1997 | Sugiyama et al. . | |
| 5,624,304 | 4/1997 | Pasch et al. . | |
| 5,626,715 | 5/1997 | Rostoker . | |
| 5,667,433 | 9/1997 | Mallon | 451/287 |
| 5,861,055 | 1/1999 | Allman et al. . | |
| 5,865,666 | 2/1999 | Nagahara . | |
| 5,868,608 | 2/1999 | Allman et al. . | |
| 5,882,251 | 3/1999 | Berman et al. . | |
| 5,888,120 | 3/1999 | Doran . | |
| 5,893,756 | 4/1999 | Berman et al. . | |
| 5,948,697 | 9/1999 | Hata . | |
| 5,957,757 | 9/1999 | Berman . | |

*Primary Examiner*—David A. Scherbel
*Assistant Examiner*—Shanlese McDonald
*Attorney, Agent, or Firm*—Beyer Weaver & Thomas, LLP

[57] ABSTRACT

An end effector to facilitate conditioning a surface of a polishing pad used in chemical-mechanical polishing of a substrate surface is described. The end effector includes an inwardly recessing contact surface capable of attaching to a conditioning disk having a conditioning surface such that the conditioning surface conforms to a substantial portion of the polishing pad, which protrudes outwardly under operation and thereby effectively conditions a substantial portion of the polishing pad. The present invention also describes a conditioning disk for effectively conditioning a surface of a polishing pad used in chemical-mechanical polishing of a substrate surface. The conditioning disk includes (i) a second surface capable of attaching to a contact surface of an end effector and (ii) an inwardly recessing conditioning surface that conforms to a substantial portion of said polishing pad, which protrudes outwardly under operation, and thereby effectively conditions the polishing pad. Processes and a chemical-mechanical polishing apparatuses employing the inventive end effectors or conditioning disks are also described.

32 Claims, 3 Drawing Sheets

EFFECTIVE PAD CONDITIONING

BACKGROUND OF THE INVENTION

The present invention relates to conditioning sub-assemblies for conditioning a polishing pad (hereinafter referred to as "pad conditioning") that are employed in chemical-mechanical polishing (sometimes referred to as "CMP") of substrates. More particularly, the present invention relates to conditioning sub-assemblies that provide conditioning surfaces that conform to the shape of the polishing pad during conditioning of a polishing pad.

As is well known in the art, an end effector and a conditioning disk are integral components of a conditioning sub-assembly, which is typically employed during conditioning of a polishing pad used for chemical-mechanical polishing (CMP) of substrates. CMP typically involves mounting a substrate, such as a semiconductor wafer, faced down on a holder and rotating the wafer face against a polishing pad mounted on a platen, which in turn rotates or orbits about an axis. A slurry containing a chemical that chemically interacts with the facing wafer layer and an abrasive that physically removes that layer is flowed between the wafer and the polishing pad or on the pad near the wafer. In semiconductor wafer fabrication, this technique is commonly applied to planarize various wafer layers such as dielectric layers, metallization layers, etc.

FIG. 1A shows some major components of a CMP apparatus such as an AvantGaard 676, which is commercially available from Integrated Processing Equipment Corporation (IPEC) of Phoenix, Ariz., disposed beneath a polishing pad 102. Polishing pad 102 includes a plurality of slurry injection holes 120 and adheres to a flexible pad backing 104, which includes a plurality of pad backing holes 1 18 aligned with slurry injection holes 120. A slurry mesh 106, typically in the form of a screen-like structure, is positioned below pad backing 104. An air bladder 108 capable of inflating or deflating is disposed between a plumbing reservoir 110 and slurry mesh 106. Air bladder 108 pressurizes to apply the required polishing force. A co-axial shaft (not shown to simplify illustration) is attached to the bottom of plumbing reservoir 110 and through which a slurry inlet (not shown to simplify illustration) is provided to deliver slurry through plumbing reservoir 110 and air bladder 108 to slurry mesh 106. Slurry is delivered to the system by an external low pressure pump. Under operation, the polishing pad "bows" or is shaped like an outwardly protruding dome as shown in FIG. 1 due to a greater force applied by air bladder 108 at a center region of polishing pad 102 than peripheral regions of polishing pad.

Unfortunately after polishing on the same polishing pad, e.g., polishing pad 102 of FIG. 1, for over a period of time, the polishing pad suffers from "pad glazing." As is well known in the art, pad glazing results when the particles eroded from the wafer surface along with the abrasives in the slurry tend to glaze or accumulate over the polishing pad. A glazed layer on the polished pad typically forms from eroded film and slurry particles that are embedded in the porosity or fibers of the polishing pad. Pad glazing is particularly pronounced during planarization of an oxide layer such as silicon dioxide layer (hereinafter referred to as "oxide CMP"). By way of example, during oxide CMP, eroded silicon dioxide particulate residue accumulates along with the abrasive particles from the slurry to form a glaze on the polishing pad. Pad glazing is undesirable because it reduces the polishing rate of the wafer surface and produces a non-uniformly polished wafer surface. The non-uniformity results because glazed layers are often unevenly distributed over a polishing pad surface.

One way of achieving and maintaining a high and stable polishing rate is by conditioning the polishing pad (hereinafter referred to as "pad conditioning") on a regular basis, i.e. either every time after a wafer or substrate has been polished or simultaneously during wafer or substrate CMP. During pad conditioning, the polishing pad is abraded to remove the glazed layer and form grooves, which facilitate slurry flow across the polishing pad and to the pad-wafer interface. FIG. 2A shows some significant components of a conditioning sub-assembly 200, which is integrated into a modern CMN system, e.g., AvantGaard 676 mentioned above. Conditioning sub-assembly 200 includes a conditioning arm 204 that is positioned above a polishing pad 102 of FIG. 1 during pad conditioning and capable of pivoting about a pivoting point 206. Conditioning arm 204, as shown in FIG. 2A, is typically longer in length than the diameter of polishing pad 102.

FIG. 2B shows a bottom view of conditioning arm 204 of FIG. 2A. The bottom surface of conditioning arm 204 includes a plurality of diamond abrasive particles 208, which are almost uniformly arranged on conditioning 204 arm such that if the conditioning arm contacts polishing pad 102, abrasive particles 208 engage a portion of the polishing pad. A manifold 210 having a plurality of openings 212 is mounted on both sides of conditioning arm 204, as shown in FIG. 2B. Openings 212 are designed to dispense a conditioning reagent on polishing pad 202 during pad conditioning and are therefore in communication with a reservoir of conditioning reagent (not shown to simplify illustration). In this configuration, openings 212 along with manifold 210 span the entire length of conditioning arm 204.

During a typical pad conditioning process, a conditioning reagent is introduced on polishing pad 102 of FIG. 2A through openings 212 of FIG. 2B and conditioning arm 204 is lowered automatically to contact polishing pad 102, which may be in orbital motion. A pneumatic cylinder then applies a downward force on conditioning arm 204 such that abrasive particles 208 of FIG. 2B engage polishing pad 102 of FIG. 2A. Conditioning arm 204 typically sweeps back and forth across polishing pad 102 like a "windshield wiper blade" from one end (shown by conditioning arm 204') of the polishing pad to another (shown by conditioning arm 204") as shown in FIG. 2A to remove the glazed or accumulated particles coated on the polishing pad surface.

FIG. 3 shows a cross-sectional view of polishing pad 102 undergoing pad conditioning as described above in reference to FIG. 2A. Beneath polishing pad 102, flexible pad backing 104, pad backing holes 118, slurry injection holes 120, slurry mesh 106, air bladder 108, and plumbing reservoir 110 are in substantially the same configuration as shown in FIG. 1.

Unfortunately, due to the bow or protruding dome shape of the polishing pad during pad conditioning, the current pad conditioning process fails to effectively condition a significant portion of polishing pad surface. FIG. 3 shows that a center region 102" of the polishing pad makes contact with abrasive particles 208, however, peripheral regions 102' of the polishing pad do not make contact with abrasive particles 208 and are not conditioned or insufficiently conditioned to remove the glazed layer (not shown to simplify illustration) on the polishing pad. Ineffective pad conditioning, therefore, fails to maintain a desirable high and stable polishing rate.

What is therefore needed is an effective pad conditioning apparatus and process, which conditions a substantial portion of the polishing pad to maintain a high and stable polishing rate.

SUMMARY OF THE INVENTION

To achieve the foregoing, the present invention provides an end effector to facilitate conditioning a surface of a polishing pad used in chemical-mechanical polishing of a substrate surface. The end effector includes an inwardly recessing contact surface capable of attaching to a conditioning disk having a conditioning surface such that the conditioning surface conforms to a substantial portion of the polishing pad, which protrudes outwardly under operation and thereby effectively conditions a substantial portion of the polishing pad.

In one embodiment, the end effector of the present invention is made from stainless steel. The end effector of the present invention may be employed in a conditioning sub-assembly of the present invention. The end effector includes the conditioning disk of a substantially uniform predetermined thickness including (i) a conditioning surface having abrasive means adapted to engage the polishing pad and (ii) a second surface adhering to the contact surface of the end effector.

The abrasive means may be a tape adhering to the conditioning surface on one side and impregnated with abrasive particles on a second side. The abrasive particles, which may include diamond and silicon carbide particles, engage at least a portion of the polishing pad during conditioning of the polishing pad to form grooves thereon. The conditioning disk may be made from at least one of stainless steel and hard plastic.

In the conditioning sub-assembly of the present invention, the conditioning surface of the conditioning disk may recesses inwardly by a maximum distance of between about 2 and about 20 mils. The predetermined thickness of the conditioning disk may be between about 0.1 and about 0.25 inches.

In another aspect, the present invention provides a conditioning disk for effectively conditioning a surface of a polishing pad used in chemical-mechanical polishing of a substrate surface. The conditioning disk includes (i) a second surface capable of attaching to a contact surface of an end-effector and (ii) an inwardly recessing conditioning surface that conforms to a substantial portion of the polishing pad, which protrudes outwardly under operation, and thereby effectively conditions the polishing pad.

The conditioning disk may be made from at least one of stainless steel and hard plastic. The thickness of the conditioning disk may be between about 0.1 and about 0.25 inches. The conditioning disk of the present invention may be employed in a conditioning sub-assembly, which may also include an end-effector having a contact surface that is substantially planar. The end-effector may be made from stainless steel.

In yet another aspect, the present invention provides a process of conditioning a polishing pad used in chemical-mechanical polishing of a substrate. The process includes (a) providing a conditioning sub-assembly having an end effector with an inwardly recessing contact surface; and a conditioning disk of substantially uniform thickness with (i) a second surface adhering to the contact surface of the end effector and (ii) a conditioning surface with abrasive means and conforming to a substantial portion of a polishing pad, which protrudes outwardly under operation; (b) rotating the conditioning sub-assembly about an axis that is perpendicular to and passes through a center point of the conditioning surface; and (c) applying a down force on the conditioning sub-assembly such that the abrasive means of the conditioning disk engages the surface of the polishing pad and the conditioning sub-assembly effectively conditions a substantial portion of the polishing pad.

The step of applying the down force includes applying a down force that may generally be between about 1 and about 15 pounds, preferably be between about 1 and about 10 pounds and more preferably be between about 1.5 and about 7 pounds.

In yet another aspect, the present invention provides a process of conditioning a polishing pad used in chemical-mechanical polishing of a substrate. The process includes (1) providing a conditioning sub-assembly having (a) an end effector having a substantially planar contact surface, and (b) a conditioning disk with (i) a second surface adhering to the contact surface of the end effector and (ii) an inwardly recessing conditioning surface with abrasive means conforming to a substantial portion of a polishing pad, which protrudes outwardly under operation; (2) rotating the conditioning sub-assembly about an axis that is perpendicular to and passes through a center point of the conditioning surface; and (3) applying a down force on the conditioning sub-assembly such that the abrasive means of the conditioning disk engages the surface of the polishing pad and the conditioning sub-assembly effectively conditions a substantial portion of the polishing pad.

In yet another aspect, the present invention provides a chemical-mechanical polishing apparatus. The apparatus includes (a) a polishing pad support apparatus having (i) a plumbing reservoir through which chemical-mechanical polishing slurry is supplied, and (ii) a polishing pad support provided above the plumbing reservoir adapted and having a dome shape such that the polishing pad supported thereon assumes the dome shape; and (b) a conditioning sub-assembly including an end effector having an inverted dome shape that is substantially complementary to the dome shape of the polishing pad, wherein a principle dimension of the end effector is at least about 70% of a corresponding principle dimension of the polishing pad.

The chemical-mechanical polishing apparatus may further include a conditioning disk of substantially uniform thickness attached to the end effector such that a conditioning surface of the conditioning disk conforms to the dome shape of the polishing pad. The conditioning surface may in turn further include an abrasive means attached to the conditioning surface of the conditioning disk. The end effector may by attached to a vertically disposed conditioning arm. The principle dimension of the end effector may be at least about 10 inches. The polishing pad support may be an air bladder.

In yet another aspect, the present invention provides a chemical-mechanical polishing apparatus. The chemical-mechanical polishing apparatus includes (a) a polishing pad support apparatus including (i) a plumbing reservoir through which chemical-mechanical polishing slurry is supplied, and (ii) a polishing pad support provided above the plumbing reservoir adapted and having a dome shape such that the polishing pad supported thereon assumes the dome shape; and (b) a conditioning sub-assembly including a conditioning disk having an inverted dome shaped conditioning surface that substantially conforms to the dome shape of the polishing pad, wherein a principle dimension of conditioning disk is at least about 70% of a corresponding principle dimension of the polishing pad.

The conditioning surface may attach to an an abrasive means. The chemical-mechanical polishing apparatus may further include an end effector having a substantially planar contact surface attached to the conditioning disk .

The present invention represents a marked improvement over the conventional pad conditioning processes. By way of example, pad conditioning according to the present invention effectively conditions a substantial portion of the polishing pad to remove the glazed layer and form grooves thereon. Consequently, the present invention is able to maintain a high and stable polishing rate over an extended period of operation and thereby prolongs the polishing pad life. As mentioned before, the conditioning sub-assembly currently employed fails to condition peripheral regions of the polishing pad and thereby reduces the polishing pad life. The present invention also considerably lowers the replacement cost of polishing pads in a substrate fabrication facility.

Pad conditioning, according to the present invention, requires that relatively minor modifications be made to the conventional pad conditioning sub-assemblies. For example, by merely replacing the conventional end effector or conditioning disk with an end effector or conditioning disk of the present invention, all the benefits of the present invention can be realized.

These and other advantages of the present invention are set forth in more detail below in the detailed description of the invention and in conjunction with the following figures.

DETAILED DESCRIPTION OF THE PREFERRED EMBODIMENTS

The present invention provides conditioning sub-assemblies, which in turn provide conditioning surfaces that conform to the shape of the polishing pad during pad conditioning. In the following description, numerous specific details are set forth in order to fully illustrate a preferred embodiment of the present invention. It will be apparent, however, that the present invention may be practiced without limitation to some specific details presented herein. It should be borne in mind that figures described herein may not be drawn to scale and that the "bow" shape of the polishing pad and the conforming end effectors and conditioning disks, which are shown and described below, may be exaggerated to facilitate a clear understanding of the present invention. Furthermore, the substrates of the present invention may include semiconductor substrates, optical substrates, magnetic media substrates, etc.

The conditioning sub-assemblies of the present invention provide conditioning surfaces that conform to the shape of the polishing pads under operation. Those skilled in the art will recognize that current conditioning sub-assemblies provide substantially planar conditioning surfaces. As set forth below, in one embodiment of the present invention, the inverted dome shape of a contact surface of an end effector facilitates in forming a conditioning surface that conforms to the shape of the polishing pad under operation. Alternatively, in another embodiment of the present invention, the inverted dome shape of the conditioning surface of the conditioning disk itself conforms to the shape of the polishing pad under operation. The term "under operation," as used herein in association with a polishing pad, refers to the state of a polishing pad when it is either being conditioned or during CMP of a substrate on the polishing pad. Furthermore, as explained above, the polishing pad under operation bows or has a protruding dome shape.

Figure 1:
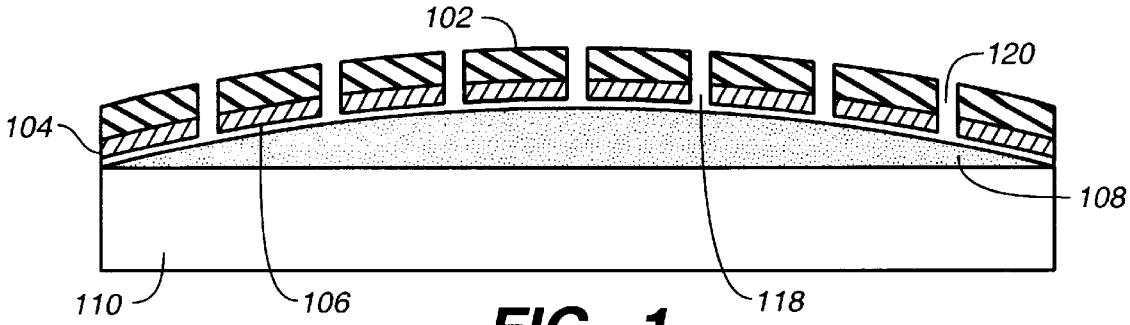
FIG. 1 shows a cross-sectional view of a polishing and part of a CMP apparatus disposed beneath the polishing pad.
Figure 3:
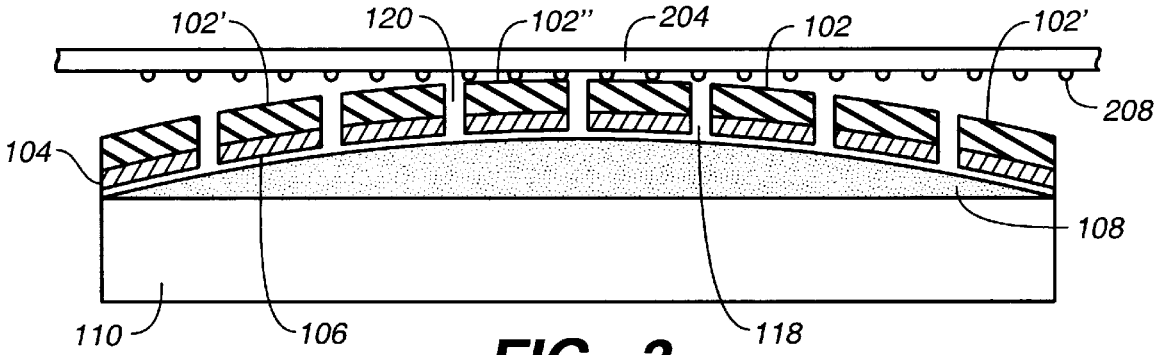
FIG. 3 shows a cross-sectional view of a polishing pad of FIG. 1 undergoing conditioning by conditioning arm of FIG. 2B.
Figure 4A:
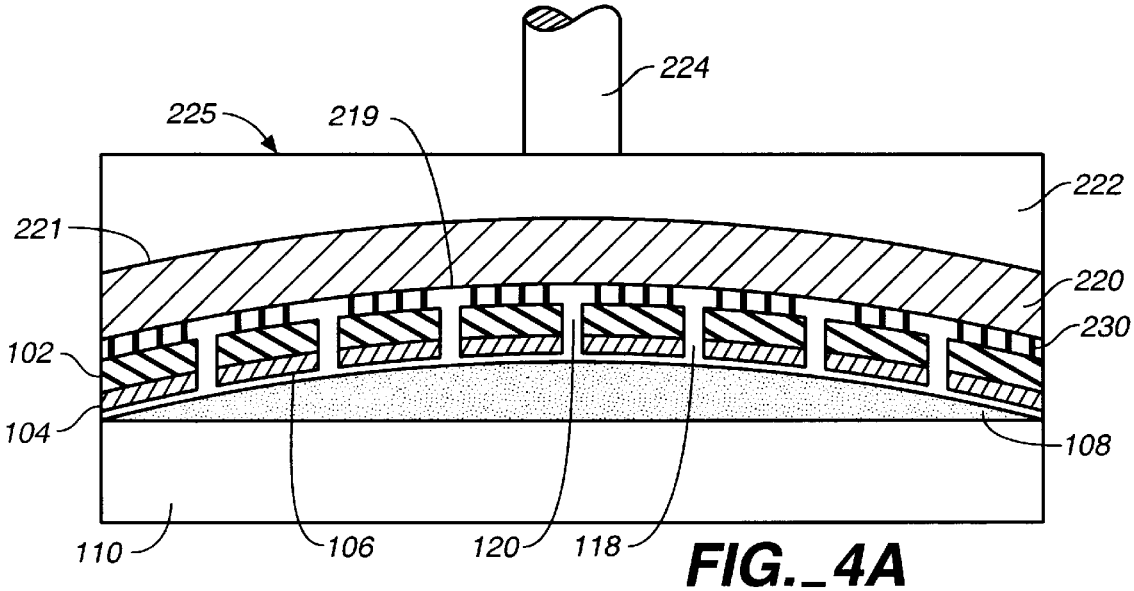
FIG. 4A shows a cross-sectional view of polishing pad undergoing conditioning by a conditioning sub-assembly, according to one embodiment of the present invention.

FIG. 4A shows a polishing pad 102 undergoing conditioning by conditioning sub-assembly 225 that is connected to a conditioning arm 224. The arrangement of polishing pad 102 and the CMP apparatus, e.g., flexible pad backing 104, pad backing holes 118, slurry injection holes 120, slurry mesh 106, air bladder 108, and plumbing reservoir 110, is in substantially the same configuration as shown in FIG. 1.

Conditioning sub-assembly 225 includes an end effector 222 having a contact surface 221, attached to which is a conditioning disk 220. A lip portion (not shown to simplify illustration) may be fitted to end effector 222, which lip portion enables contact surface 221 to attach to conditioning disk 220. Contact surface 221 concaves or recesses inwardly into end effector 222 by a sufficient amount such that when a conditioning disk of substantially uniform predetermined thickness is attached to contact surface 221, a conditioning surface 219 of conditioning disk 220 conforms to the shape of the polishing pad under operation as shown in FIG. 4A. Conditioning surface 219 of conditioning disk 220 includes abrasive particles 230 that engage polishing pad 102 and condition the polishing pad during pad conditioning.

According to the present invention, after the degree of protrusion of the dome shaped polishing pad under operation is established, the shape and dimensions of end-effector 222 and thickness of conditioning disk 220 may be determined so that conditioning surface 219 substantially conforms to a substantial portion of polishing pad 102. By way of example, for a polishing pad that is about 50 mils thick, the maximum distance of bowing is generally between about 2 and about 20 mils. In this example, the contact surface of the end-effector recesses inwardly by a sufficient amount so that upon attaching to a conditioning disk having a predetermined thickness of between about 0.1 and about 0.25 inches, for example, the conditioning surface of the conditioning disk conforms to the polishing pad.

Figure 4B:
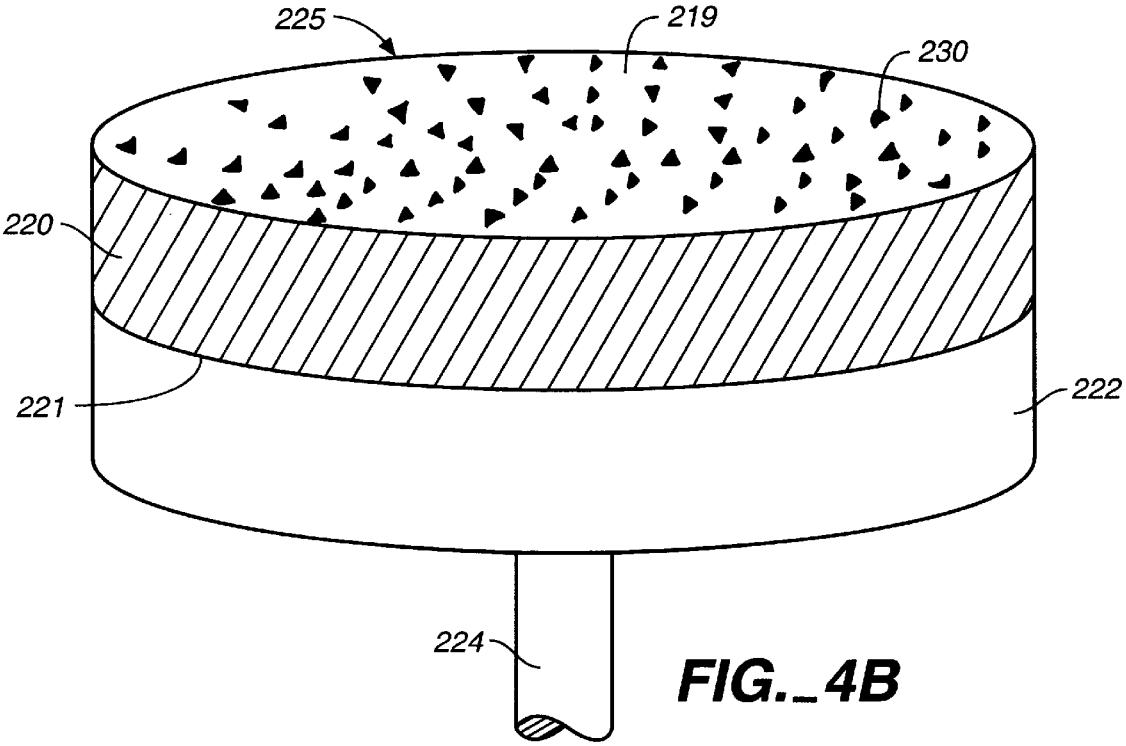
FIG. 4B shows a top perspective view of the conditioning sub-assembly of FIG. 4A in an inverted position.

For further illustration, FIG. 4B shows a top perspective view of an inverted conditioning sub-assembly 225, including end effector 222 disposed below conditioning disk 220. In FIG. 4B, conditioning arm 204, contact surface 221 of end-effector 222, conditioning surface 219 of conditioning disk 220 and abrasive particles 230 are in substantially the same configuration as shown in FIG. 4B.

End effector 222 and conditioning disk 220 may be made from a rigid material, such as stainless steel. In an alternative embodiment, the conditioning disk of the present invention may be made from a flexible material, e.g., a hard plastic material, that is flexible enough to allow the conditioning surface to effectively conform to the surface of the polishing pad under operation. In order to condition a substantial portion of the polishing pad surface, end-effector 222 and conditioning disk 220 may have the same diameter as the polishing pad. By way of example, in the AvantGaard 676, which typically employs a polishing pad having a diameter of about 10.5 inches, the size of end effector 222 and/or conditioning disk 220 may also be about 10.5 inches. As another example, end effector 222 and/or conditioning disk 220 may include at least one principle dimension (e.g., diameter) that is at least about 70% of a corresponding principle dimension (e.g., diameter) of the polishing pad.

Abrasive particles 230 may be made from any suitable abrasive materials, e.g., diamond particles, silicon carbide, etc., well known to those skilled in the art. For pad conditioning in oxide CMP (which refers to CMP of a silicon dioxide layer on a wafer surface), abrasive particles 230 preferably include diamond particles. Abrasive particles 230 may be secured on conditioning surface 219 in many ways. In one embodiment, abrasive particles 230 of the present invention are fabricated directly on a surface of the conditioning disk using conventional techniques well known to those skilled in the art. By way of example, abrasive particles 230 may be initially embedded on or fixed to conditioning surface 219, and then conditioning surface 219 including abrasive particles 230 undergoes nickel plating to effectively secure the abrasive particles to the conditioning surface.

In another embodiment, abrasive particles 230 may be fabricated directly on one side of a strip using techniques well known to those skilled in the art and the other side of the strip adheres to conditioning surface 219 via an adhesive material, such as glue or epoxy. In yet another embodiment, tape with embedded diamond grit adhered to the surface, which is commercially available from Marshall Laboratories of Marshall, Minn., can be employed.

Figure 5:
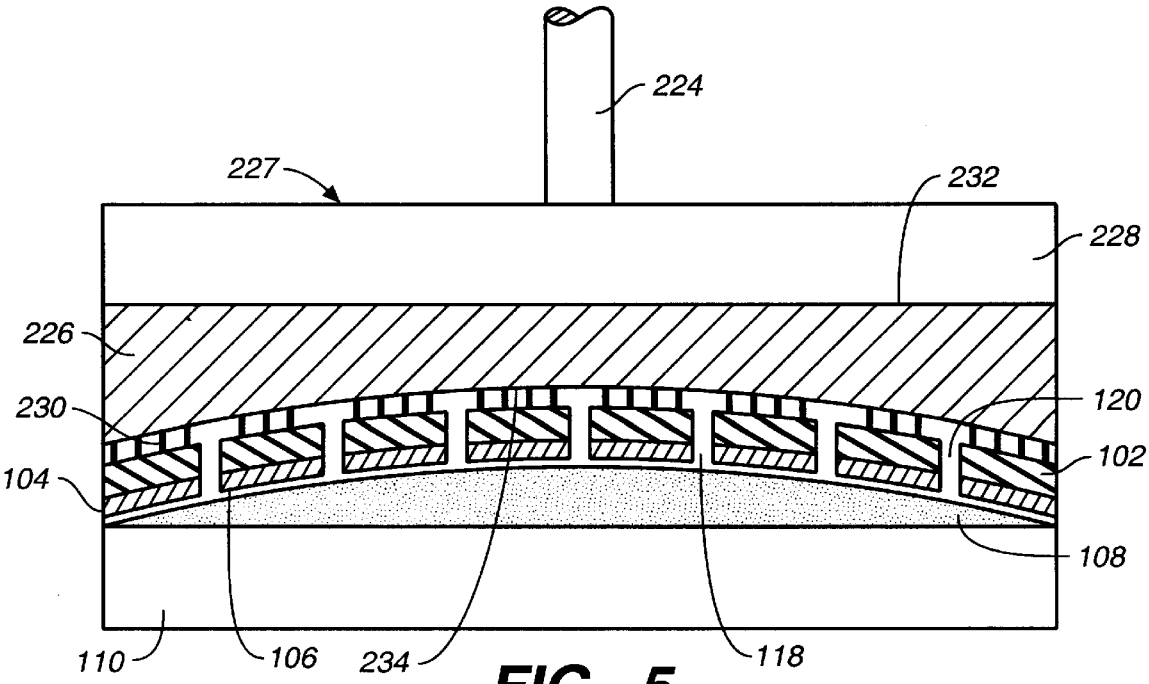
FIG. 5 shows a cross-sectional view of polishing pad undergoing conditioning by a conditioning sub-assembly, according to another embodiment of the present invention.
Figure 2A:
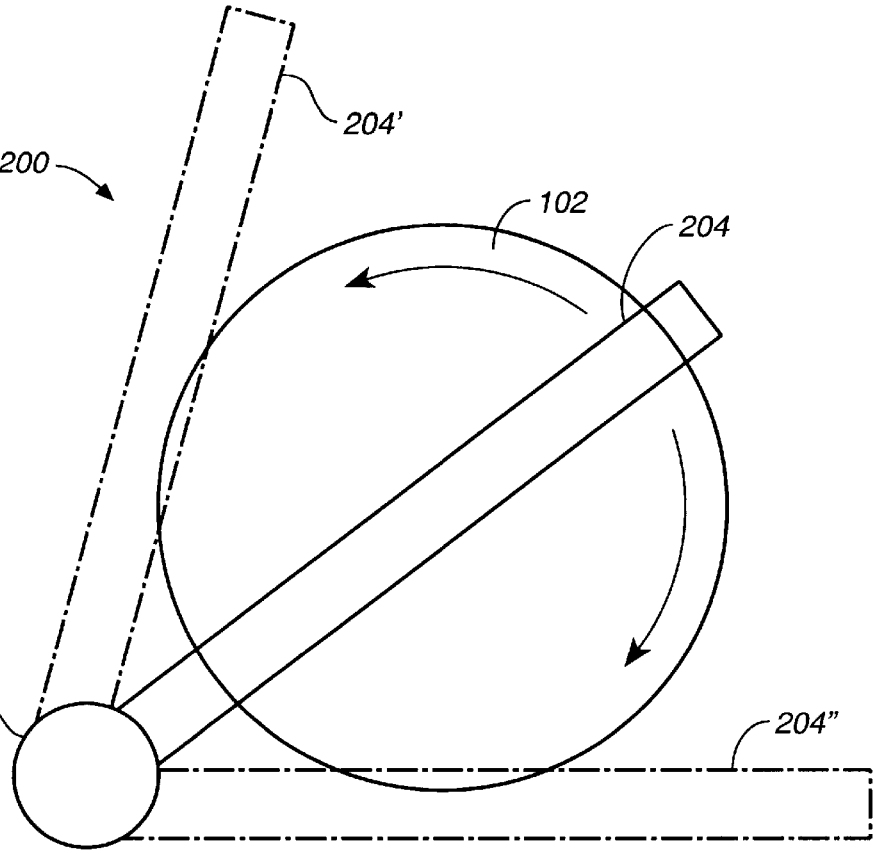
FIG. 2A shows a top view of a polishing pad of FIG. 1 undergoing pad conditioning by a conditioning arm of a conditioning sub-assembly currently employed.
Figure 2B:
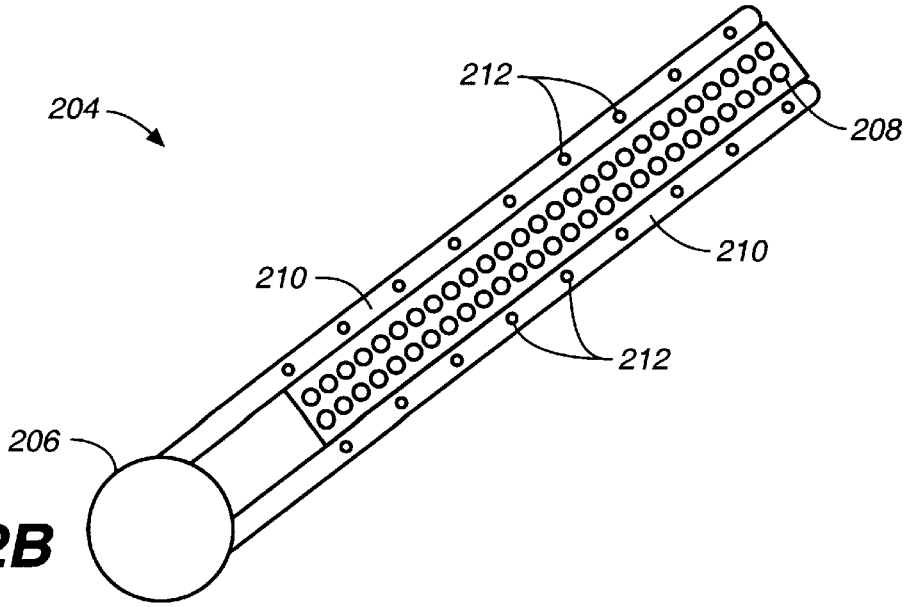
FIG. 2B shows a bottom view of the conditioning arm of FIG. 2A.

FIG. 5 shows polishing pad 102 of FIG. 1 undergoing conditioning, according to another embodiment of the present invention, by a conditioning sub-assembly 227 that is connected to conditioning arm 224. In FIG. 5, polishing pad 102 and the CMP apparatus, e.g., flexible pad backing 104, pad backing holes 118, slurry injection holes 120, slurry mesh 106, air bladder 108, and plumbing reservoir 110, is in substantially the same configuration as shown in FIG. 1.

Conditioning sub-assembly 227 includes an end effector 228 having a substantially planar contact surface 232, attached to which is a conditioning disk 226 having a conditioning surface 234. Conditioning surface 234 includes abrasive particles 230 and concaves or recesses inwardly such that it conforms to the shape of the polishing pad under operation as shown in FIG. 5.

For a polishing pad that is about 50 mils thick and where the maximum distance of bowing in the polishing pad under operation is generally between about 2 and about 20 mils, the conditioning surface also recesses inwardly by a maximum distance of between about 2 and 20 mils.

A pad conditioning process, according to one embodiment of the present invention, includes employing the conditioning sub-assemblies of FIGS. 4A and 5. In one embodiment, the pad conditioning process begins when the conditioning sub-assembly is lowered on a polishing pad. By way of example, as shown in FIG. 4A, conditioning sub-assembly 225 is lowered to contact polishing pad 102. In this position it is preferably to have the conditioning sub-assembly rotate about an axis that is perpendicular to and passes through a center point of the conditioning surface. In another embodiment, the conditioning sub-assembly may rotate in one direction for a few seconds, then stop and rotate in the opposite direction for a few seconds to ensure that a substantial amount of the glazed layer is removed. In yet another embodiment, in the AvantGaard 676, for example, the conditioning sub-assembly sweeps back and forth similar to a windshield wiper blade to ensure that a substantial amount of glazed layer is removed.

A sufficient down force is then applied, on the conditioning sub-assembly such that the abrasive surface of the conditioning disk engages the polishing pad. In one embodiment of the present invention, the down force is applied by a pneumatic cylinder, which is connected to the conditioning sub-assembly. For a polishing pad that is made of at least one material selected from the group consisting of urethane, polyurethane, felt polymer and a filler material, the down force may generally be between about 1–15 pounds (lbs), preferably be between about 1–10 pounds (lbs) and more preferably be between about 1.5 and 71bs. Abrasive particles, e.g., 230 of FIGS. 4A and 5, engage the polishing pad to remove the glazed layer and form microgrooves thereon. As mentioned before, microgrooves may facilitate slurry flow across the polishing pad and to the pad-wafer interface and thereby enhance the polishing rate of a wafer layer.

The present invention represents a marked improvement over the conventional pad conditioning processes. By way of example, pad conditioning according to the present invention effectively conditions a substantial portion of the polishing pad to remove the glazed layer and form grooves thereon. Consequently, the present invention is able to maintain a high and stable polishing rate over an extended period of operation and thereby prolongs the polishing pad life. As mentioned before, the conditioning sub-assembly currently employed fails to condition peripheral regions of the polishing pad and thereby reduces the polishing pad life. The present invention also considerably lowers the replacement cost of polishing pads in a substrate fabrication facility.

Pad conditioning, according to the present invention, requires that relatively minor modifications be made to the conventional pad conditioning sub-assemblies. For example, by merely replacing the conventional end effector or conditioning disk with an end effector or conditioning disk of the present invention, all the benefits of the present invention can be realized.

Although the foregoing invention has been described in some detail for purposes of clarity of understanding, it will be apparent that certain changes and modifications may be practiced within the scope of the appended claims. For example, while the specification has described in terms of chemical-mechanical polishing, there is no reason why in principle the teachings of the present invention cannot be applied to other polishing applications. Therefore, the present embodiments are to be considered as illustrative and not restrictive, and the invention is not to be limited to the details given herein, but may be modified within the scope of the appended claims.

What is claimed is:

1. An end effector to facilitate conditioning a surface of a polishing pad used in chemical-mechanical polishing of a substrate surface, said end effector comprising a concave contact surface capable of attaching to a conditioning disk having a conditioning surface such that said conditioning surface conforms to a substantial portion of said polishing pad, which protrudes outwardly under operation and thereby effectively conditions a substantial portion of the polishing pad.

2. The end effector of claim 1, wherein the end effector is made from stainless steel.

3. A conditioning sub-assembly, comprising:

the end effector of claim 1, and said conditioning disk of a substantially uniform predetermined thickness including (i) a conditioning surface having abrasive means adapted to engage the polishing pad and (ii) a second surface adhering to the contact surface of the end effector.

4. The conditioning sub-assembly of claim 3, wherein the abrasive means is a tape adhering to the conditioning surface on one side and impregnated with abrasive particles on a second side, said abrasive particles engage at least a portion of the polishing pad during conditioning of the polishing pad to form grooves thereon.

5. The conditioning sub-assembly of claim 4, wherein the abrasive particles include at least one of diamond particles and silicon carbide particles.

6. The conditioning sub-assembly of claim 3, wherein the conditioning disk is made from at least one of stainless steel and hard plastic.

7. The conditioning sub-assembly of claim 3, wherein the conditioning surface of the conditioning disk recesses inwardly by a maximum distance of between about 2 and about 20 mils.

8. The conditioning sub-assembly of claim 3, wherein the predetermined thickness of the conditioning disk is between about 0.1 and about 0.25 inches.

9. A conditioning disk for effectively conditioning a surface of a polishing pad used in chemical-mechanical polishing of a substrate surface, said conditioning disk comprises (i) a second surface capable of attaching to a contact surface of an end effector and (ii) a concave conditioning surface that conforms to a substantial portion of said polishing pad, which protrudes outwardly under operation, and thereby effectively conditions the polishing pad.

10. The conditioning disk of claim 9, wherein said conditioning disk is made from at least one of stainless steel and hard plastic.

11. The conditioning disk of claim 9, wherein the thickness of the conditioning disk is between about 0.1 and about 0.25 inches.

12. A conditioning sub-assembly, comprising:

an end effector having a contact surface that is substantially planar; and the conditioning disk of claim 9.

13. The conditioning sub-assembly of claim 12, wherein said end effector is made from stainless steel.

14. A process of conditioning a polishing pad used in chemical-mechanical polishing of a substrate, comprising:

providing a conditioning sub-assembly including:

an end effector having a concave contact surface; and a conditioning disk of substantially uniform thickness having (i) a second surface adhering to the contact surface of the end effector and (ii) a conditioning surface with abrasive means and conforming to a substantial portion of a polishing pad, which protrudes outwardly under operation;

rotating said conditioning sub-assembly about an axis that is perpendicular to and passes through a center point of the conditioning surface; and applying a down force on said conditioning sub-assembly such that said abrasive means of said conditioning disk engages the surface of said polishing pad and said conditioning sub-assembly effectively conditions a substantial portion of the polishing pad.

15. The process of claim 14, wherein in said applying the down force is between about 1 and about 15 pounds.

16. The process of claim 15, wherein the down force is between about 1 and about 10 pounds.

17. The process of claim 16, wherein the down force is between about 1.5 and about 7 pounds.

18. A process of conditioning a polishing pad used in chemical-mechanical polishing of a substrate, comprising:

providing a conditioning sub-assembly including:

an end effector having a substantially planar contact surface; and a conditioning disk having (i) a second surface adhering to the contact surface of the end effector and (ii) a concave conditioning surface with abrasive means conforming to a substantial portion of a polishing pad, which protrudes outwardly under operation;

rotating said conditioning sub-assembly about an axis that is perpendicular to and passes through a center point of the conditioning surface; and applying a down force on said conditioning sub-assembly such that said abrasive means of said conditioning disk engages the surface of said polishing pad and said conditioning sub-assembly effectively conditions a substantial portion of the polishing pad.

19. The process of claim 18, wherein said abrasive means is an abrasive tape that attaches to the conditioning surface on one side and impregnated with abrasive particles on a second side.

20. The process of claim 18, wherein in said applying the down force is between about 1 and about 15 pounds.

21. A chemical-mechanical polishing apparatus, comprising:

(a) a polishing pad support apparatus including a plumbing reservoir through which chemical-mechanical polishing slurry is supplied, and a polishing pad support provided above said plumbing reservoir adapted and having a concave shape such that the polishing pad supported thereon assumes the concave shape; and (b) a conditioning sub-assembly including an end effector having a concave shape that is substantially complementary to the convex shape of the polishing pad, wherein a principle dimension of said end effector is at least about 70% of a corresponding principle dimension of the polishing pad.

22. The chemical-mechanical polishing apparatus of claim 21, further comprising a conditioning disk of substantially uniform thickness attaching to the end effector such that a conditioning surface of said conditioning disk conforms to the convex shape of the polishing pad.

23. The chemical-mechanical polishing apparatus of claim 22, further comprising an abrasive means attached to said conditioning surface of said conditioning disk.

24. The chemical-mechanical polishing apparatus of claim 21, further comprising a vertically disposed conditioning arm attached to the end effector.

25. The chemical-mechanical polishing apparatus of claim 21, wherein the principle dimension of the end effector is at least about 10 inches.

26. The chemical-mechanical polishing apparatus of claim 21, wherein the polishing pad support is an air bladder.

27. A chemical-mechanical polishing apparatus, comprising:

(a) a polishing pad support apparatus including a plumbing reservoir through which chemical-mechanical polishing slurry is supplied, and a polishing pad support provided above said plumbing reservoir adapted and having a concave such that the polishing pad supported thereon assumes the concave shape; and (b) a conditioning sub-assembly including a conditioning disk having a concave shaped conditioning surface that substantially conforms to the convex of the polishing pad, wherein a principle dimension of conditioning disk is at least about 70% of a corresponding principle dimension of the polishing pad.

28. The chemical-mechanical polishing apparatus of claim 27, further comprising an abrasive means attached to said conditioning surface of said conditioning disk.

29. The chemical-mechanical polishing apparatus of claim 27, further comprising an end effector having a substantially planar contact surface attached to the conditioning disk.

30. The chemical-mechanical polishing apparatus of claim 29, further comprising a vertically disposed conditioning arm attached to the end effector.

31. The chemical-mechanical polishing apparatus of claim 27, wherein the principle dimension of the conditioning disk is at least about 10 inches.

32. The chemical-mechanical polishing apparatus of claim 27, wherein the polishing pad support is an air bladder.

* * * * *